US006065642A

United States Patent [19]

Brown

[11] Patent Number: 6,065,642

[45] Date of Patent: May 23, 2000

[54] NON-VENTING VALVE AND DISPENSING PACKAGE FOR FLUID PRODUCTS AND THE LIKE

[75] Inventor: Paul E. Brown, Midland, Mich.

[73] Assignee: AptarGroup, Inc., Crystal Lake, Ill.

[21] Appl. No.: 09/207,937

[22] Filed: Dec. 9, 1998

[51] Int. Cl.[7] ..... B65D 35/38

[52] U.S. Cl. ..... 222/92; 222/494

[58] Field of Search ..... 222/92, 105, 181.1, 222/490, 494

[56] References Cited

U.S. PATENT DOCUMENTS

| | | | |
|---|---|---|---|
| 1,206,661 | 11/1916 | Booth . | |
| 1,738,080 | 12/1929 | Smith | 222/494 |
| 1,825,553 | 9/1931 | Smith . | |
| 1,989,714 | 2/1935 | Statham | 221/60 |
| 2,175,052 | 10/1939 | Bull et al. | 221/60 |
| 2,555,490 | 6/1951 | Horn | 222/494 |
| 2,758,755 | 8/1956 | Schafler | 222/213 |
| 3,342,379 | 9/1967 | Foley | 222/173 |
| 3,490,488 | 1/1970 | Grist | 133/512.4 |
| 4,166,553 | 9/1979 | Fraterrigo | 222/181 |
| 4,408,702 | 10/1983 | Horvath | 222/212 |
| 4,434,810 | 3/1984 | Atkinson | 137/493 |
| 4,470,523 | 9/1984 | Spector | 222/181 |
| 4,728,006 | 3/1988 | Drobish et al. | 222/181 |
| 4,749,108 | 6/1988 | Dornsbusch et al. | 222/212 |
| 4,987,740 | 1/1991 | Coleman | 60/583 |
| 4,991,745 | 2/1991 | Brown | 222/212 |
| 5,033,655 | 7/1991 | Brown | 222/212 |
| 5,071,017 | 12/1991 | Stull | 215/260 |
| 5,115,950 | 5/1992 | Rohr | 222/490 |
| 5,213,236 | 5/1993 | Brown et al. | 222/185 |
| 5,339,995 | 8/1994 | Brown et al. | 222/185 |
| 5,377,877 | 1/1995 | Brown et al. | 222/105 |
| 5,409,144 | 4/1995 | Brown | 222/185 |
| 5,439,143 | 8/1995 | Brown et al. | 222/185 |
| 5,839,614 | 11/1998 | Brown | 202/185 |
| 5,971,227 | 10/1999 | Garibaldi | 222/207 |

FOREIGN PATENT DOCUMENTS

| | | |
|---|---|---|
| 26719/88 | 9/1989 | Australia . |
| 0226290 | 6/1987 | European Pat. Off. . |
| 0278125 | 8/1988 | European Pat. Off. . |
| 0395380 | 10/1990 | European Pat. Off. . |
| 996998 | 12/1951 | France . |
| 1135210 | 4/1957 | France . |
| 2354093 | 5/1970 | Germany . |
| 2128875 | 12/1972 | Germany . |
| 2609310 | 9/1976 | Germany . |
| 5873738 | 5/1983 | Japan . |
| 1046518 | 10/1966 | Switzerland . |
| 145824 | 6/1962 | U.S.S.R. . |
| 2098958 | 12/1982 | United Kingdom . |

*Primary Examiner*—Joseph A. Kaufman
*Attorney, Agent, or Firm*—Rockey, Milnamow & Katz, Ltd.

[57] ABSTRACT

A non-venting valve and dispensing package for fluid products and the like includes a container of the type having an interior volume which reduces as fluid product is dispensed from the package. A self-sealing dispensing valve has a marginal portion sealing about an associated discharge opening in the container, and a valve head with an orifice which shifts between open and closed positions in response to the application and release of pressure on and/or within the container. A vent resisting member retains the orifice in the closed position after each dispensing of fluid product from the container to prevent ambient air from being drawn back through the orifice into the container.

29 Claims, 8 Drawing Sheets

NON-VENTING VALVE AND DISPENSING PACKAGE FOR FLUID PRODUCTS AND THE LIKE

BACKGROUND OF THE INVENTION

The present invention relates to packaging for fluid products and the like, and in particular to a non-venting valve and associated dispensing package.

Many different types of packages and containers are presently available for packaging non-solid products of the type which are capable of flowing, such as fluid or fluidized materials, including liquids, pastes, powders, and the like, which substances are collectively and generically referred to herein as "fluids". Some such packages include a dispenser, which permits a selected amount of fluid to be discharged from the package, and then reseals to close the package.

Self-sealing dispensing valves have been used in packaging for certain types products, such as the container disclosed in U.S. Pat. No. 4,728,006 to Drobish et al, which is designed for shampoos, conditioners, and the like. However, such valves have been known to experience certain types of sealing problems and inconsistent dispensing characteristics, particularly when the packages are exposed to significant temperature variations.

Liquid silicone rubber valves have recently been used is some types of packaging, and have proven particularly advantageous since the material is inherently quite inert, and will therefore not either adulterate or react with the packaged products. Examples of such valves and related packaging are provided in Applicant's U.S. Pat. Nos. 5,033,655; 5,213,236; 5,377,877; and 5,409,144 to Brown et al, which are hereby incorporated herein by reference.

Some types of fluid products such as selected personal care items, cosmetics, hair care products, medications, foodstuffs, drinks, etc. begin to deteriorate when exposed to air. Hence, they are typically difficult to package in dispensing types of containers. It is preferable to package such products in containers which are either collapsible, or include collapsing interior liners, so that the interior volume of the container decreases as fluid product is drawn out of the package, thereby minimizing exposure of the product to ambient air.

SUMMARY OF THE INVENTION

One aspect of the present invention is a non-venting dispensing valve and associated package for fluid products and the like, including a container of the type having an interior volume which reduces as fluid product is dispensed from the package. A self-sealing dispensing valve has a marginal portion sealing about an associated discharge open in the container, and a valve head with an orifice which shifts between open and closed positions in response to the application and release of pressure on and/or within the container. A vent resisting member retains the orifice in the closed position after each dispensing of fluid product from the container to prevent ambient air from being drawn back through the orifice into the container.

The principal objects of the present invention are to provide a dispensing valve and package which will not draw air back into the container after dispensing, and is therefore particularly adapted for use in packaging air sensitive products, such as medications, cosmetics, personal care creams, pastes, lotions, drinks, and other similar products. The dispensing package has a self-sealing type of valve which opens and closes automatically for easy of use. The dispensing package has an uncomplicated design, and is relatively inexpensive to manufacture. The dispensing package is efficient in use, capable of long operating life, and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 6:
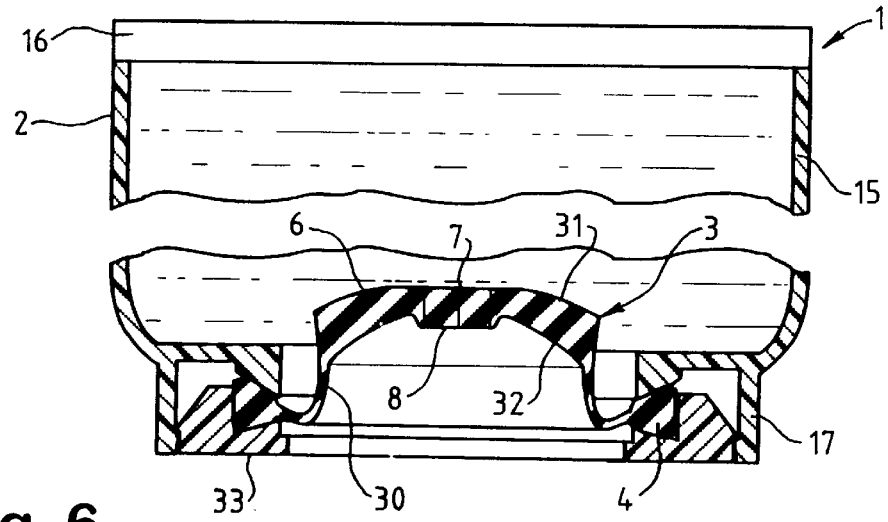
FIG. 6 is a fragmentary cross-sectional view of the dispensing package, with the valve shown in a fully retracted and fully closed position.
Figure 7:
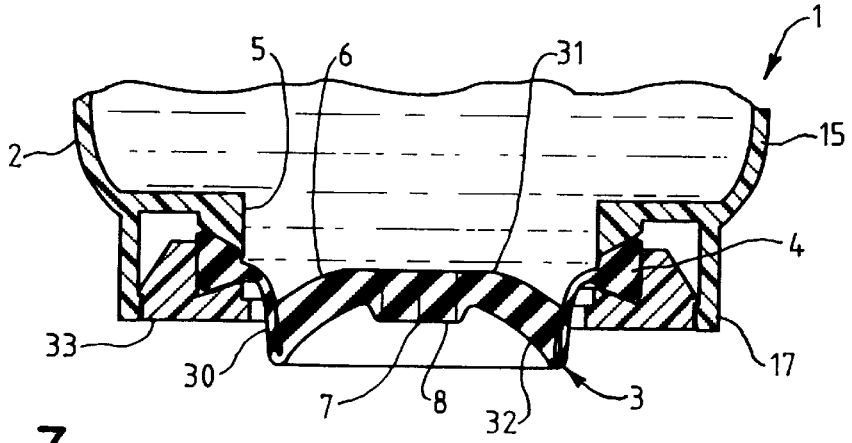
FIG. 7 is a fragmentary cross-sectional view of the dispensing package, showing the valve in a partially extended and fully closed position.
Figure 8:
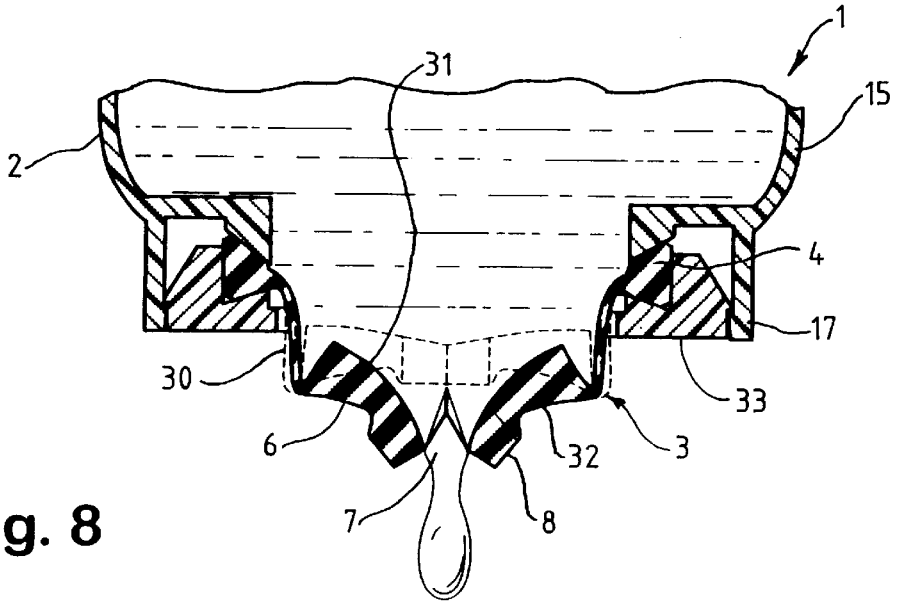
FIG. 8 is a fragmentary cross-sectional view of the dispensing package, showing the valve in a fully extended and fully open position.

For purposes of description herein, the terms "upper", "lower", "right", "left", "rear", "front", "vertical", "horizontal" and derivatives thereof shall relate to the invention as oriented in FIGS. 6–8. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
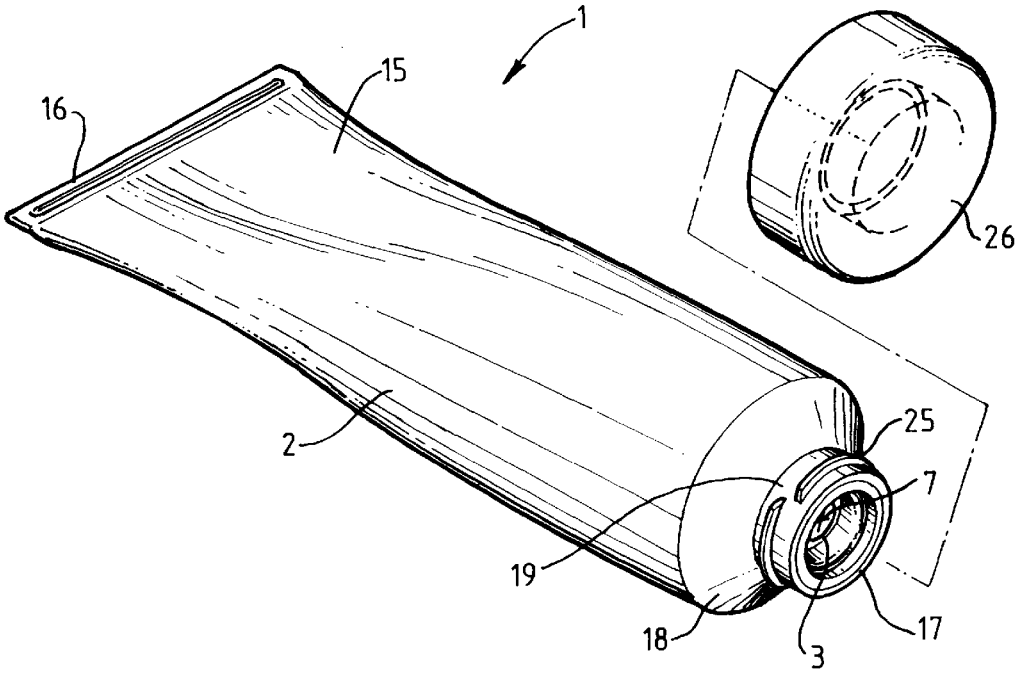
FIG. 1 is an exploded perspective view of a non-venting dispensing package embodying the present invention.
Figure 2:
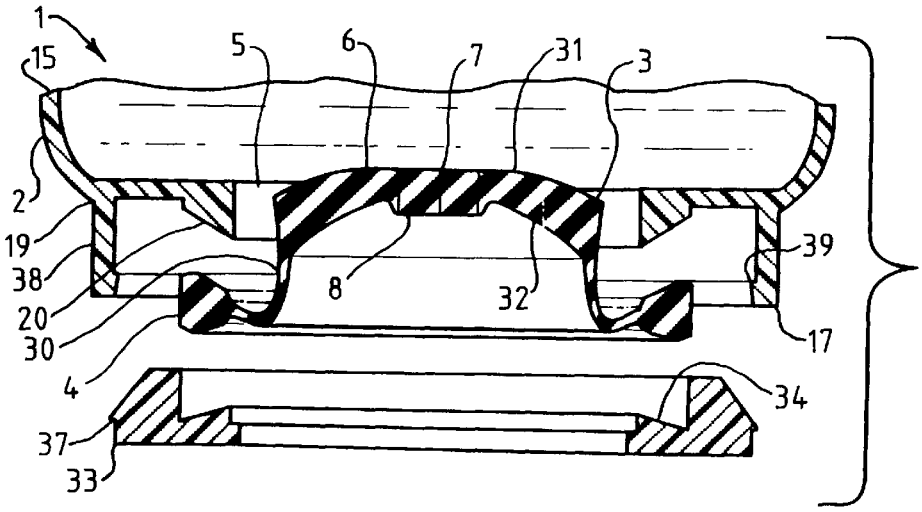
FIG. 2 is a fragmentary cross-sectional view of the dispensing package, which includes a container, a self-sealing valve, and a valve retainer.
Figure 3:
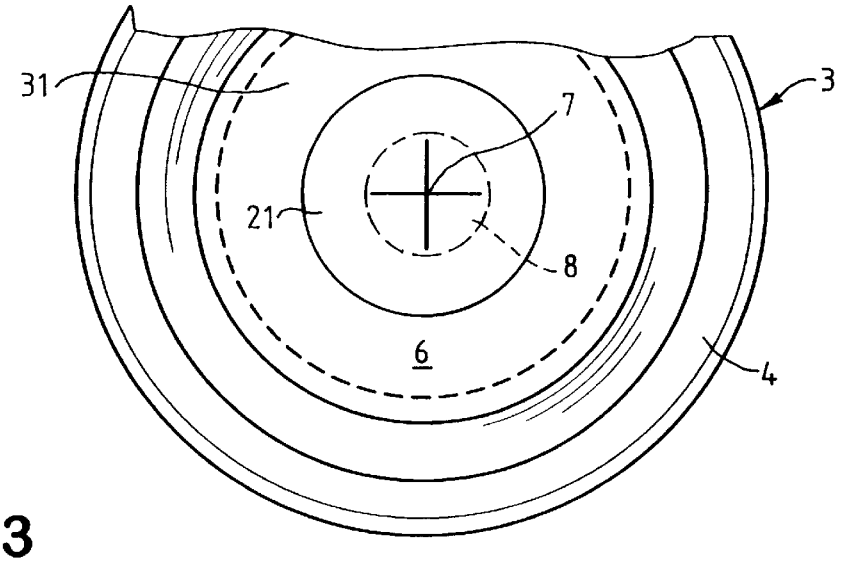
FIG. 3 is a fragmentary top plan view of the valve.
Figure 4:
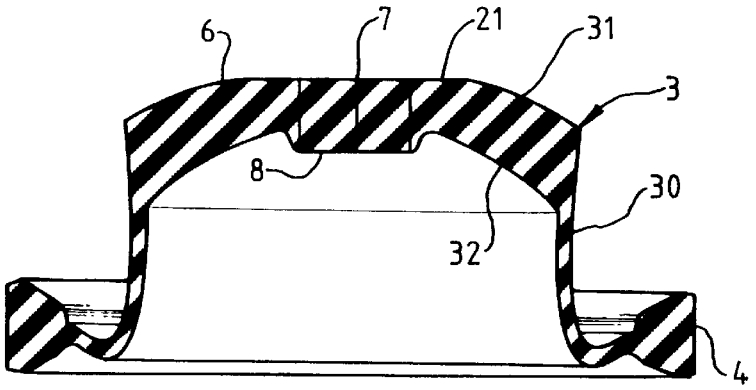
FIG. 4 is a cross-sectional view of the valve.
Figure 5:
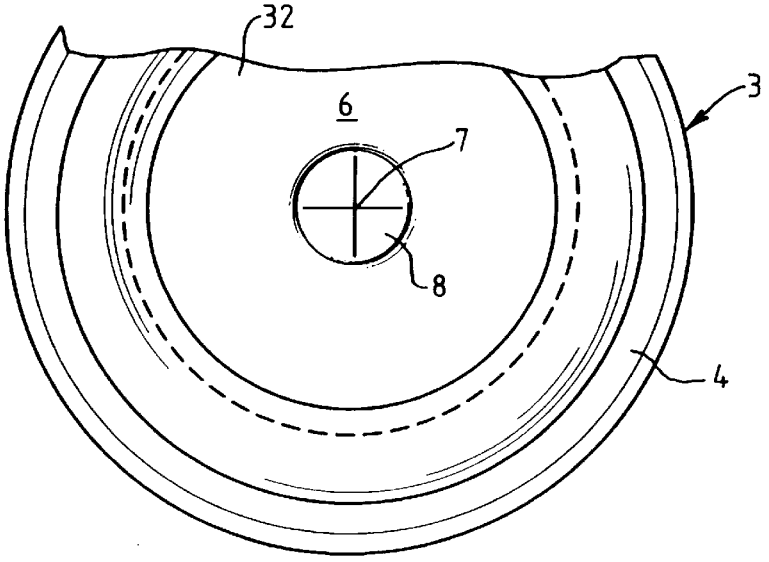
FIG. 5 is a fragmentary bottom plan view of the valve.

The reference numeral 1 (FIGS. 1 and 2) generally designates a dispensing package embodying the present invention. Dispensing package 1 includes a container 2 of the type that has an interior volume which decreases as fluid product is dispensed from package 1. A self-sealing valve 3 has a marginal portion 4 sealing about an associated discharge opening 5 in container 2, and a valve head 6 with an orifice 7 which shifts between open and closed positions in response to the application and release of pressure on and/or within container 2. A vent resisting member, which in the example illustrated in FIGS. 1–10 comprises a pad 8, retains orifice 7 in the closed position after each dispensing of fluid product from container 2 to prevent ambient air from being drawn back through orifice 7 into container 2.

The illustrated container 2 (FIGS. 1 and 2) is in the nature of a tube, which includes flexible sidewalls 15 that are squeezed to dispense fluid product from container 2. Tube 2 has a closed end 16 and a dispensing end 17 in the form of a collar 18 with a neck 19 that projects outwardly therefrom. The discharge opening 5 of container 2 is located at the neck 19, which in the example illustrated in FIG. 2, includes a beveled valve seat 20 to facilitate mounting valve 3 in container 2. Container 2 may be constructed from a wide variety of different materials, including metal foils, plastics, and the like, and is preferably adapted to retain fluid product therein, such as selected personal care items, hair care products, medications, cosmetics, foodstuffs, drinks, and the like, without contaminating the same. In the example illustrated in FIG. 1, neck 19 includes an exterior thread 25 to facilitate removably mounting an associated travel cap 26 thereon.

In the examples illustrated in FIGS. 1–10, self-sealing valve 3 is shaped somewhat similar to the dispensing valve disclosed in related U.S. Pat. No. 5,213,236, except for the addition of pad 8. Dispensing valve 3 (FIGS. 3–5) includes a resiliently flexible connector sleeve portion 30, which has one end portion thereof connected with the marginal or flange portion 4 of valve 3, and an opposite end portion thereof connected with the head portion 6 of valve 3. As discussed in the Brown et al U.S. Pat. No. 5,213,236, self-sealing valve 3 assumes a generally concave orientation when in the fully closed position shown in FIG. 6, and a convex orientation when in the fully open position shown in FIG. 8.

The connector sleeve portion 30 (FIGS. 3–5) of self-sealing valve 3 permits head portion 6 of valve 3 to shift between the fully open and fully closed positions. The connector sleeve 30 illustrated in FIGS. 6–8 has a J-shaped, longitudinal, cross-sectional shape, and the radially outer area of head portion 6 has a tapered thickness, wherein the radially inner portion of the head portion 6 disposed toward orifice 7 is thinner than the radially outer portion of head portion 6. The illustrated head portion 6 has an arcuately shaped interior or inner surface 31, and an arcuately shaped exterior or outer surface 32. The valve head inner surface 31 communicates with the fluid product, and has a radius greater than the outer surface 32, which communicates with ambient environment. Inner surface 31 has a flat center area 21, with a circular plan shape disposed concentric with the center of orifice 7.

The self-sealing valve 3 illustrated in FIGS. 6–8 is in the form of a one-piece valve, having a hat-shaped side elevational configuration in its as molded or normal condition. The resilient flexibility of connector sleeve 30 permits the same to double over and then extend rollingly, in the nature of a rolling diaphragm with valve head portion 6 mounted at the center thereof in a manner which permits the valve head portion 6 to shift or float freely inwardly and outwardly in an axial direction with respect to the discharge opening 5 in container 2.

The reciprocating motion of valve head portion 6 and flexible connector sleeve portion 30 provides dispensing package 1 with several important advantages. For example, connector sleeve portion 30 is preferably configured with sufficient flexibility that abnormal pressure increases developed within the interior of container 2, such as those caused by thermal expansion, vibrations, shock impact forces, and the like are offset by the axial shifting motion of valve head portion 6 with respect to marginal flange portion 4, so as to alleviate excess pressure on discharge orifice 7.

Another example of the benefits achieved by the reciprocating motion of valve head portion 6 on connector sleeve portion 30 is that connector sleeve portion 30 is preferably configured with sufficient flexibility that any misalignments and/or distortions of the valve flange portion 4 are not transmitted to the valve head portion 6, thereby permitting unhindered operations of discharge orifice 7. The flexible connector sleeve portion 30 tends to insulate or isolate the valve head portion 6 from marginal flange portion 4, such that it can float freely, and thereby avoid problems associated with distortion of the orifice 7 or valve head portion 6. This feature is particularly important in the illustrated dispensing package, wherein container 2 is constructed from a highly flexible material, such as the illustrated tube. When pressure is applied to the container 2 to dispense fluid product therefrom, collar 18 can distort somewhat, particularly as the dispensing package 1 approaches an empty condition. The flexible nature of connector sleeve portion 30 permits valve head portion 6 to reciprocate freely, even when collar 18 becomes distorted, thereby ensuring good flow characteristics and avoiding leakage.

Yet another benefit achieved by the reciprocating motion of valve head portion 6 is that connector sleeve portion 30 is preferably configured with sufficient flexibility that a fairly moderate pressure (i.e., one which is substantially lower than the predetermined opening pressure of orifice 7) is required to shift the valve head portion 6 from the fully retracted and fully closed position shown in FIG. 6 to the fully extended and fully closed position shown in FIG. 7, thereby improving the dispensing "feel" of dispensing package 1. When the user grasps container 2 and applies force to sidewalls 15, the pressure generated within the interior of container 2 causes the valve head portion 6 to shift on flexible connector sleeve portion 30 between the fully retracted and fully closed position shown in FIG. 6 to the fully extended and fully closed position shown in FIG. 7, at which point valve head portion 6 halts momentarily, with further movement of the valve head portion 6 being resisted until additional forces are exerted on container 2, which requires an internal pressure within container 2 greater than the predetermined opening pressure of orifice 7. This motion of flexible connector sleeve portion 30 and valve head portion 6 is sensed by the user through touch or feel, typically in the form of a vibration or ripple experienced in the container sidewalls when valve head portion 6 reaches the fully extended and fully closed position (FIG. 7). The ripple motion signals the user that valve head portion 6 is fully extended, and that further pressure will cause orifice 7 to snap open and dispense fluid product. When orifice 7 snaps open and closed, similar vibrations or ripples are communicated to the user through the container sidewalls to assist in achieving accurate flow control.

In the illustrated examples, orifice 7 is defined by a pair of slits, oriented in a mutually perpendicular relationship. However, it is to be understood that the present invention contemplates other orifice configurations consistent with the no-vent feature of dispensing package 1.

Figure 9:
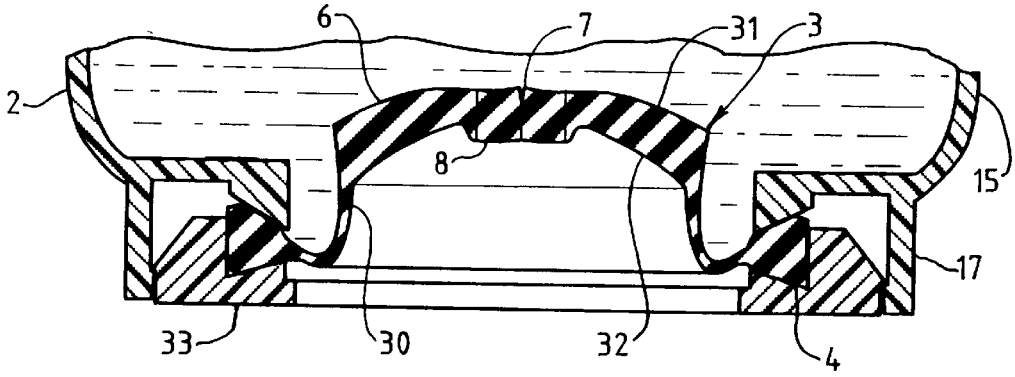
FIG. 9 is a fragmentary cross-sectional view of the dispensing package, showing the valve in a fully retracted and fully closed position immediately after dispensing.

While the shape of the illustrated self-sealing closure is similar to that disclosed in the Brown et al U.S. Pat. No. 5,213,236, the self-sealing valve shown in FIGS. 1–10 includes a vent resisting pad 8, which as shown in FIG. 9, retains orifice 7 in the closed position after each dispensing of fluid product from container 2 to prevent ambient air from being drawn back through orifice 7 into container 2. In the example shown in FIGS. 1–10, vent resisting pad 8 is disposed on the exterior surface 32 of valve head 6 at a location adjoining orifice 7. The vent resisting pad 8 is formed integrally with and projects outwardly of the exterior surface of valve head 6, with orifice 7 extending through pad 8. The illustrated vent resisting pad 8 is cylindrical or disc-shaped, with a flat free surface, and a circular plan configuration. The thickness of pad 8, as measured by the additional amount of material added to a similar valve without a pad, is at least 10 to 80 percent of the thickness of the valve head 6 at its thinnest point. In other words, the total thickness of the illustrated valve head 6 at pad 8 is around 1.20–1.50 times the thickness of valve head 6 at its thinnest point, which in the examples shown in FIGS. 2–9, is immediately adjacent to pad 8.

In one working embodiment of the present invention, the radius of inner surface 31 is around 0.383 inches, the radius of outer surface 32 is around 0.297 inches, the diameter of valve head 6 is around 0.419 inches, the diameter of pad 8 is around 0.120 inches, the orifice 7 is formed by cross slits having a length of around 0.100, the valve head 6 has a thickness of around 0.040 inches, the additional thickness provided by pad 8 is around 0.020 inches, and the total thickness of valve head 6 at orifice 7 is around 0.057 inches. The free surface of pad 8 and the inner surface area 21 of valve head 6 are parallel, such that pad 8 interrupts the otherwise tapered thickness of valve head 6.

In the embodiments shown in FIGS. 2–9, a retainer ring 33 is provided to mount valve 3 in container 2. The illustrated retainer ring 33 (FIG. 2) includes a beveled seat 34 which is shaped to closely receive therein an adjacent portion of valve flange 4. Retainer ring 33 has an annular shape, with an outwardly protruding bead 37, which snaps into a hollow collar portion 38 of container neck 19 and engages a mating lip 39 to securely mount valve 3 in container 2 with a snap fit (FIGS. 6–8). It is to be understood that the present invention also contemplates other arrangements for mounting valve 3 in container 2.

Figure 10:
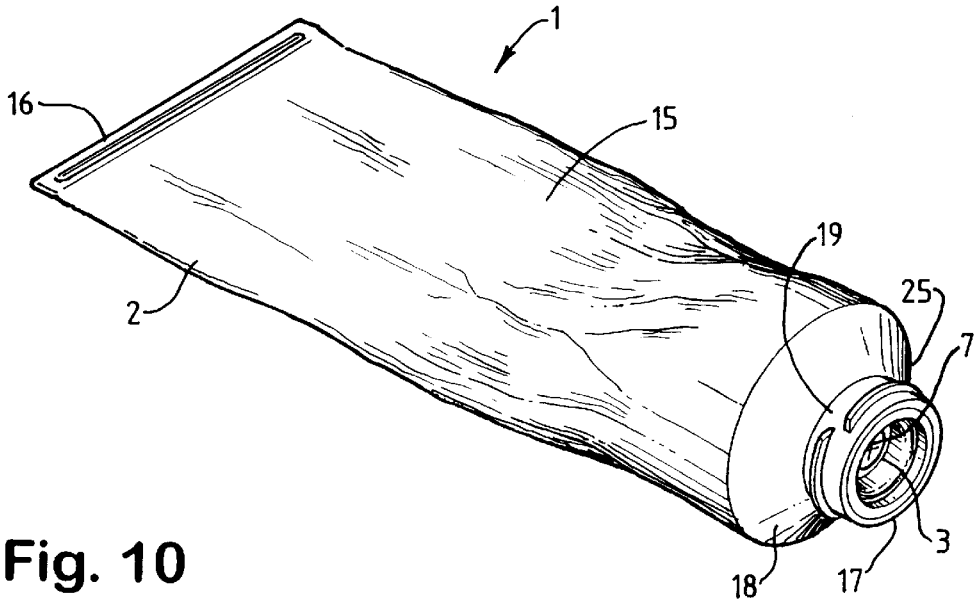
FIG. 10 is a perspective view of the dispensing package shown in a partially collapsed condition.

In operation, a filled dispensing package 1 can be used to dispense the fluid product by simply applying pressure to the sidewalls 15 of container 2. A stream or dollop of fluid product is thereby dispensed from dispensing package 1 by shifting valve member 3 from the fully retracted and fully closed position shown in FIG. 6 to the fully extended and fully open position shown in FIG. 8. The specific size and configuration of valve 3 is preferably adjusted in accordance with the type of container 2 to achieve the particular dispensing flow desired for a selected fluid product. Upon release of pressure on the container sidewalls 15, sidewalls 15 may exhibit at least some tendency to assume their prior configuration, which requires drawing air back through orifice 7 into the interior of container 2. However, pad 8 provides increased thickness to valve head 6, which prevents orifice 7 from opening, such that air is not drawn back into the interior of container 2. Continued dispensing of fluid product from package 1 will cause container 2 to at least partially collapse, as shown in FIG. 10.

Figure 11:
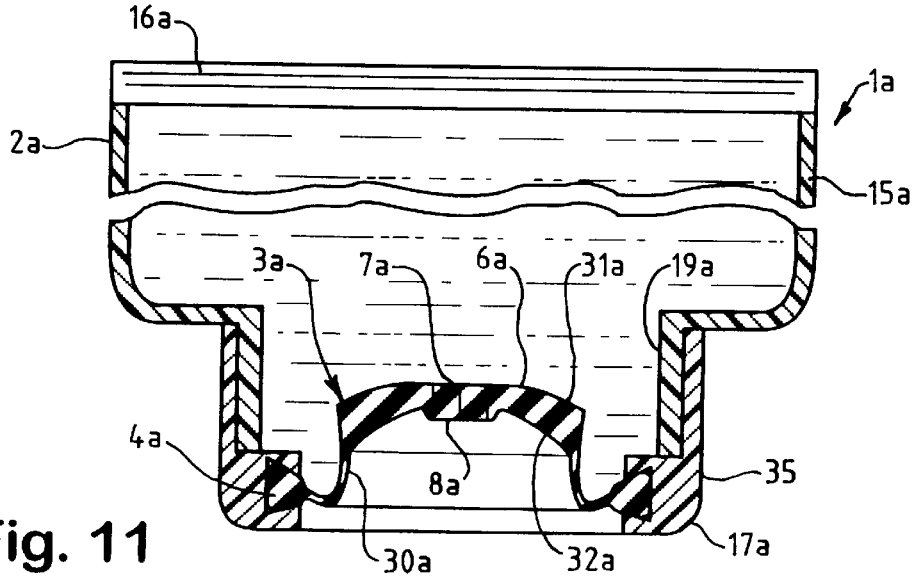
FIG. 11 is a fragmentary cross-sectional view of another embodiment of the present invention.

The reference numeral 1*a* (FIG. 11) generally designates another embodiment of the present invention. Since dispensing package 1*a* is similar to the previously described dispensing package 1, similar parts appearing in FIGS. 1–10 and FIG. 11 respectively, are represented by the same, corresponding reference numeral, except for the suffix "a" in the numerals of the latter. In dispensing package 1*a,* instead of using a snap-type retainer ring 33 to mount valve 3*a* in container 2*a,* as described above, valve 3*a* is formed integrally in an overcap 35, which is in turn mounted to the neck 19*a* of container 2*a* by means such as threads, adhesives, heat or sonic welding, or the like. Dispensing package 1*a* operates in a fashion substantially identical to dispensing package 1, as described above.

Figure 12:
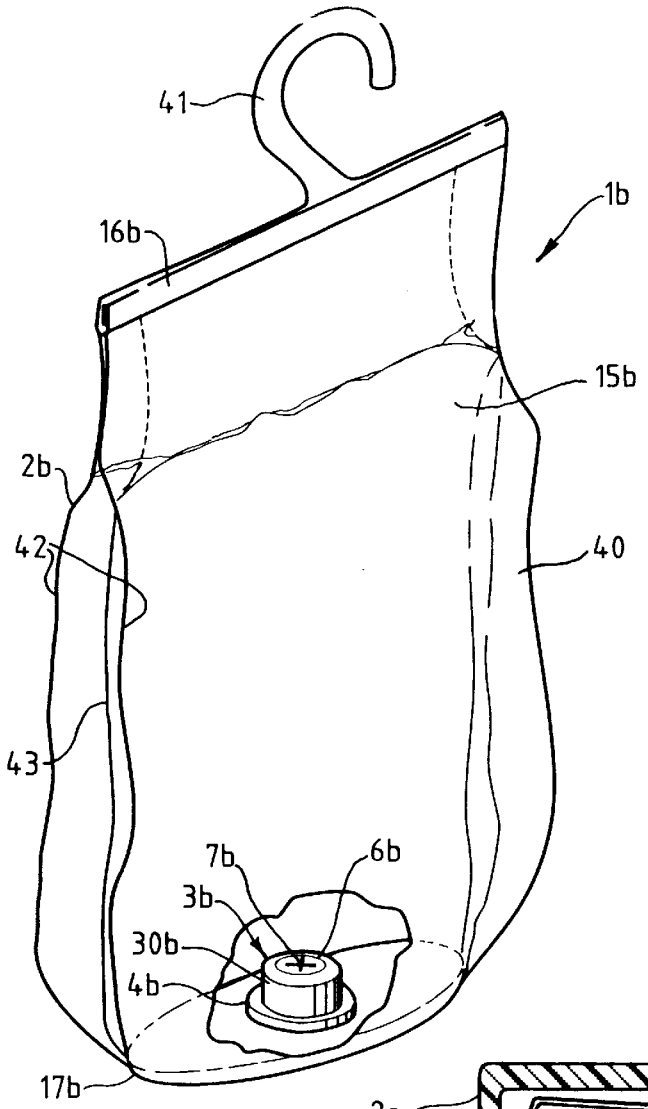
FIG. 12 is a perspective view of yet another embodiment of the present invention.

The reference numeral 1*b* (FIG. 12) generally designates yet another embodiment of the present invention. Since dispensing package 1*b* is similar to the previously described dispensing package 1, similar parts appearing in FIGS. 1–10 and FIG. 12 respectively, are represented by the same, corresponding reference numeral, except for the suffix "b" in the numerals of the latter. In dispensing package 1*b,* container 2*b* is in the nature of a flexible bag 40 with a hook 41 mounted adjacent the upper portion thereof to facilitate hanging container 2*b* from an associated support (not shown). Bag 40 also includes flexible sidewalls 42 with central folds 43 along opposite sides thereof which assist in permitting bag sidewalls 42 to fully collapse as product is dispensed from container 2*b*.

Figure 13:
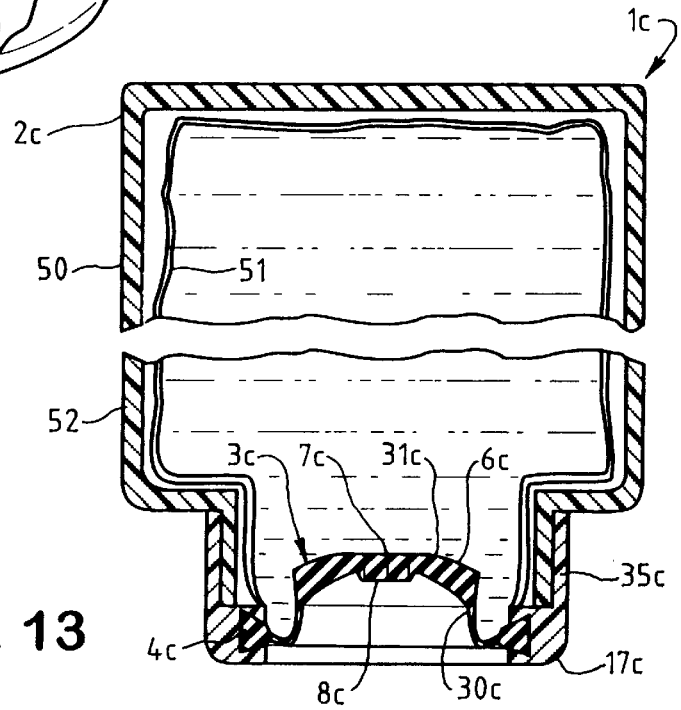
FIG. 13 is a fragmentary cross-sectional view of yet another embodiment of the present invention.
Figure 14:
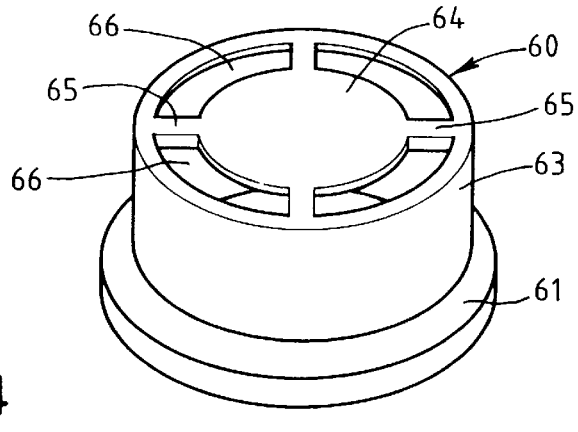
FIG. 14 is a perspective view of another embodiment of the present invention which includes a valve retainer.
Figure 15:
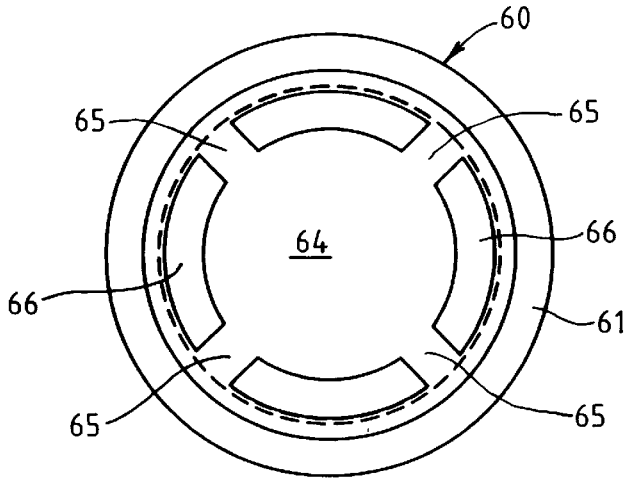
FIG. 15 is a top plan view of the valve retainer.

The reference numeral 1*c* (FIG. 13) generally designates yet another embodiment of the present invention. Since dispensing package 1*c* is similar to the previously described dispensing package 1, similar parts appearing in FIGS. 1–10 and FIG. 13 respectively, are represented by the same, corresponding reference numeral, except for the suffix "c" in the numerals of the latter. In dispensing package 1*c,* container 2*c* includes a rigid outer portion 50 in which a collapsible bag 51 is mounted. While the sidewalls 52 of outer portion 50 are flexible, they are resilient, and do not collapse or otherwise inelastically deform. Rather, the outer portion 50 of container 2*c* is vented to the atmosphere, such that when fluid product is dispensed from dispensing package 1*c* through valve 3*c,* bag 51 collapses within the interior of container outer portion 50, such that air is not drawn back into the interior of bag 51.

The reference numeral 1*d* (FIGS. 14–17) generally designates yet another embodiment of the present invention. Since dispensing package 1*d* is similar to the previously described dispensing package 1, similar parts appearing in FIGS. 1–10 and FIGS. 14–17 respectively, are represented by the same corresponding reference numeral, except for the suffix "d" in the numerals of the latter. In dispensing package 1*d,* the vent resisting member is in the form of a perforate retainer 60 which is positioned on the interior side of container 2*d,* and abuts the head portion 6*d* of valve 3*d* to prevent orifice 7*d* from opening after liquid product is dispensed from container 2*d*. The illustrated retainer 60 has a generally circular plan configuration, and includes an annularly shaped collar 61 that is closely received in an associated recess 62 in container neck 19*d*. Retainer 60 has a cylindrically shaped body portion 63 which has a hollow interior, and one end connected with collar 61, and the opposite end connected with a stop pad 64. Stop pad 64 has a circular plan configuration, with a diameter substantially smaller than that of retainer body 63. Support arms 65 extend radially from stop pad 64 and are connected with the retainer body 63 to securely retain stop pad 64 at the associated end of retainer body 63. Arcuately shaped apertures 66 are thereby formed between the interior of retainer body 63 and stop pad 64 through which fluid product flows during dispensing.

Figure 16:
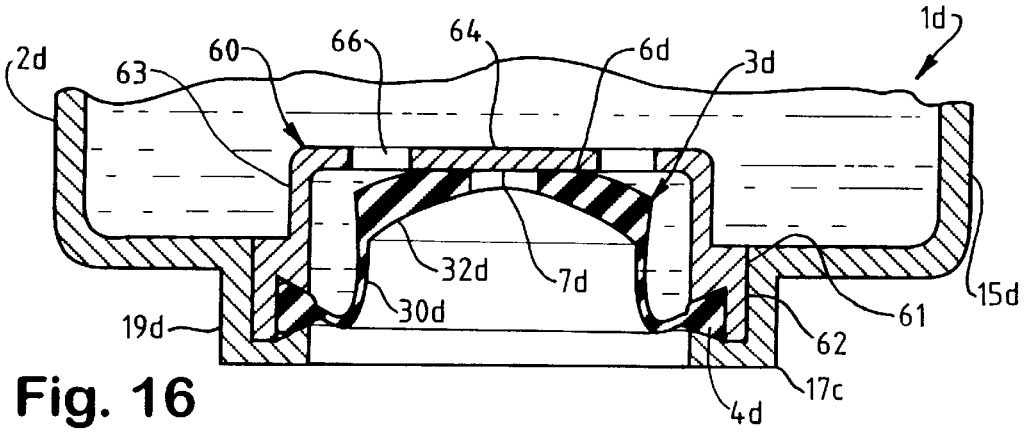
FIG. 16 is a fragmentary cross-sectional view of the valve retainer shown installed in a package with the associated valve in a fully retracted and fully closed position immediately after dispensing.

As best illustrated in FIG. 16, valve 3*d* is similar to the previously described valve 3, except that it does not include a vent resisting pad 8. Valve 3*d* is therefore similar to the valves disclosed in Applicant's prior U.S. Pat. Nos. 5,033,655; 5,213,236 and others. The collar portion 61 of retainer 60 mounts valve 3*d* in the neck portion 19*d* of container 2*d*, such that stop pad 64 is oriented inwardly toward the interior of container 2*d*. With valve 3*d* in the normally closed, fully retracted position shown in FIG. 16, stop pad 64 just touches or abuts valve head 6*d* on the exterior surface 32 thereof.

Figure 17:
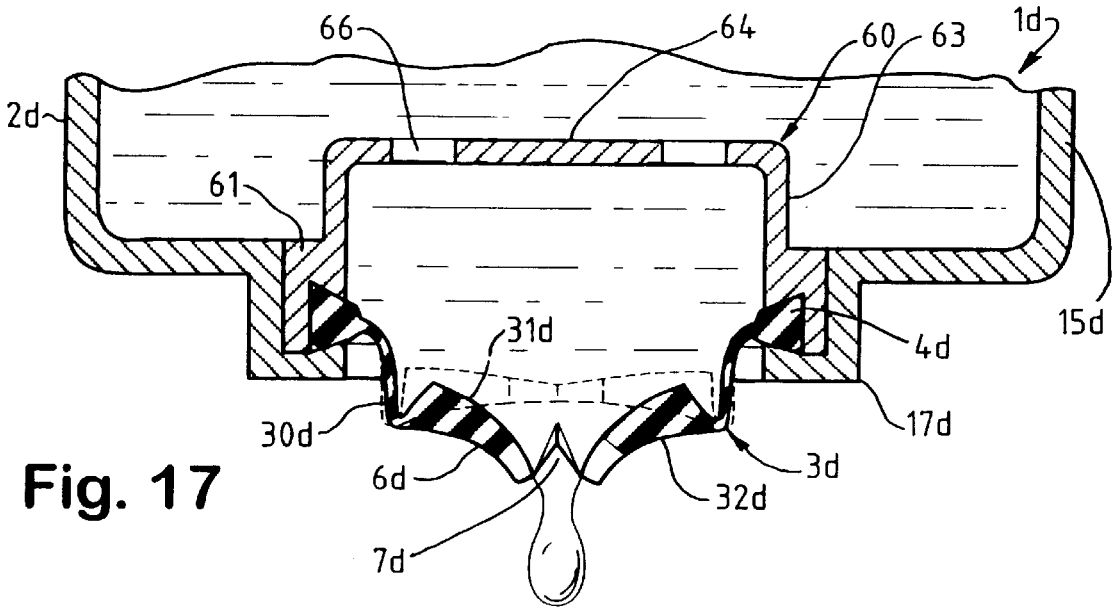
FIG. 17 is a fragmentary cross-sectional view of the dispensing package shown in FIG. 16, wherein the valve is shown in a fully extended and fully open position.

During operation of dispensing package 1*d* (FIGS. 14–17), when pressure is applied to the associated container 2*d*, valve 3*d* shifts in a manner similar to that described above to dispense fluid product from container 2*d*, as shown in FIG. 17. When pressure is released from container 2*d*, valve 3*d* returns to the fully closed, fully retracted position shown in FIG. 16. Should the sidewalls 15*d* of container 2*d* attempt to return to their original shape, and thereby apply a vacuum to the interior of dispensing package 1*d*, contact between support pad 64 and valve head 6*d* prevents orifice 7*d* from opening, such that air cannot be drawn back into the interior of the container 2*d*.

Figure 18:
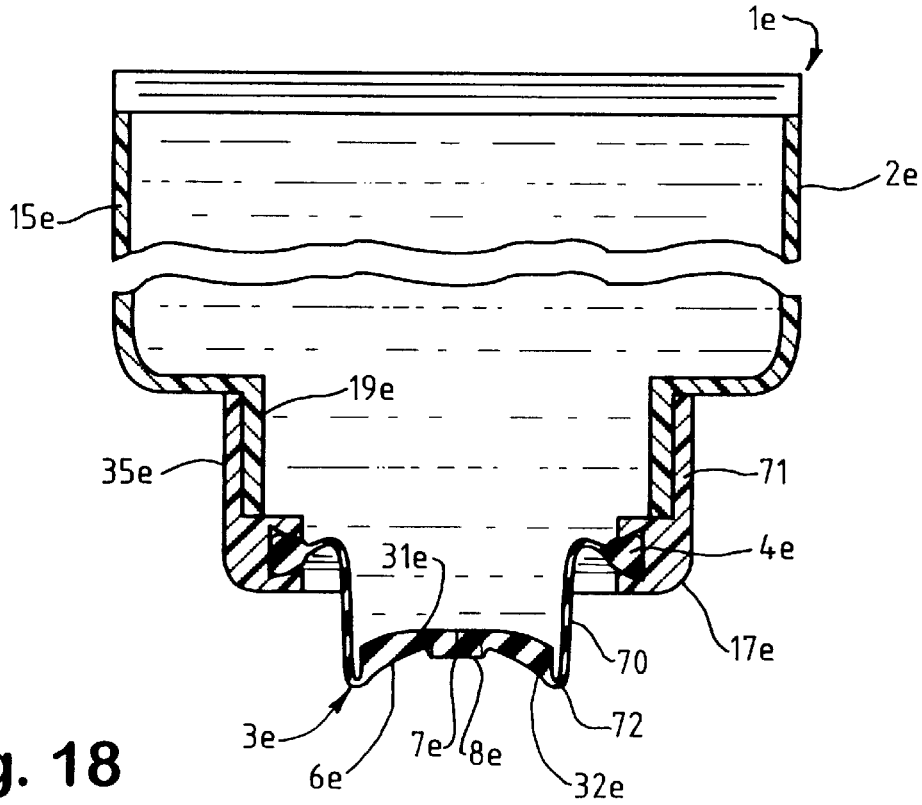
FIG. 18 is a fragmentary cross-sectional view of yet another embodiment of the present invention, wherein the associated valve is shown in a fully retracted and fully closed position prior to dispensing.
Figure 19:
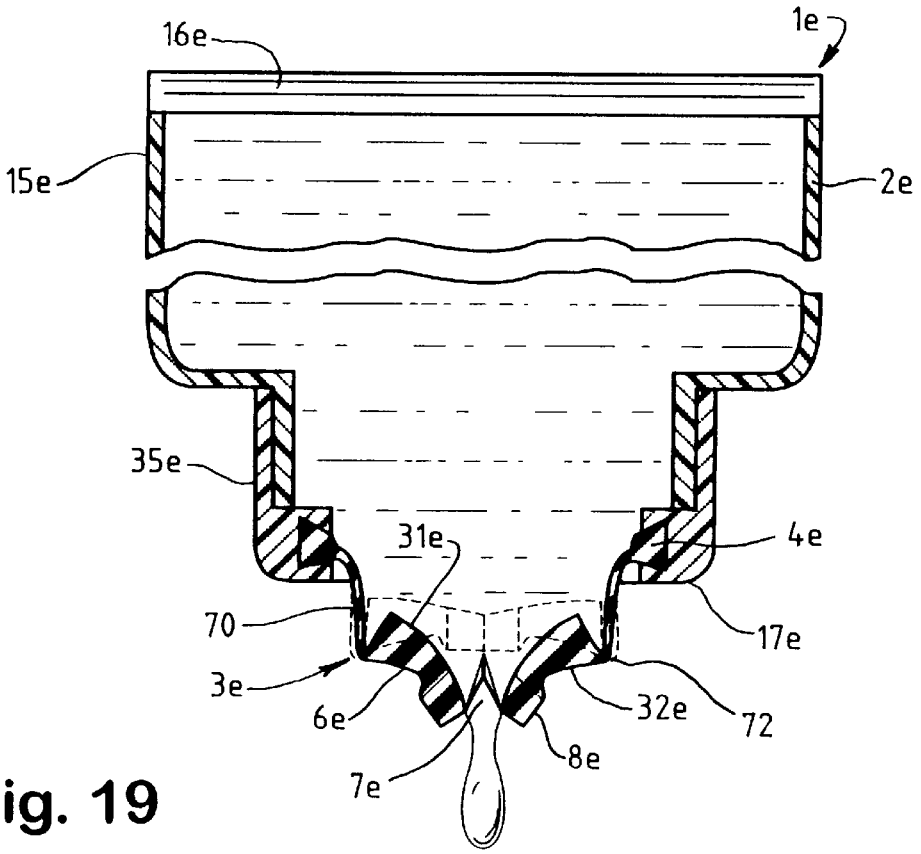
FIG. 19 is a fragmentary cross-sectional view of the dispensing package shown in FIG. 18, wherein the valve is shown in a fully retracted and fully open position.

The reference numeral 1*e* (FIGS. 18–20) generally designates yet another embodiment of the present invention. Since dispensing package 1*e* is similar to the previously described dispensing package 1, similar parts appearing in FIGS. 1–10 and FIGS. 18–20 respectively, are represented by the same, corresponding reference numeral, except for the suffix "e" in the numerals of the latter. In dispensing package 1*e*, self-sealing valve 3*e* has a different configuration from previously described valve 3. Dispensing valve 3*e* is similar to the dispensing valve disclosed in FIGS. 17–23 of Applicant's co-pending U.S. patent application Ser. No. 08/508,472 filed Jul. 28, 1995, entitled DISPENSING PACKAGE, which is hereby incorporated herein by reference. More specifically, the valve 3*e* illustrated in FIGS. 18–20 herein includes an alternate connector sleeve 70 which positions valve head 6*e* in a normally outwardly extended position, as shown in FIG. 18. The marginal portion 4*e* of valve 3*e* is integrally molded in an overcap 71, which is in turn attached to the neck portion 19*e* of container 2*e* by means such as threads, adhesive, heat or sonic welding, or other similar techniques. That portion of connector sleeve 70 disposed adjacent marginal flange portion 4*e* is also J-shaped, but with the opposite end portion 72 also in the form of a "J" shape, so that connector sleeve 70 attaches to the valve head portion 6*e* adjacent the outer surface 32*e* thereof. The valve head 6*e* is similar to the previously described valve head 6, and includes arcuate inner and outer surfaces 31*e* and 32*e* which have a tapered construction, and include vent resisting pad 8*e* disposed on the exterior surface 32*e* thereof.

Figure 20:
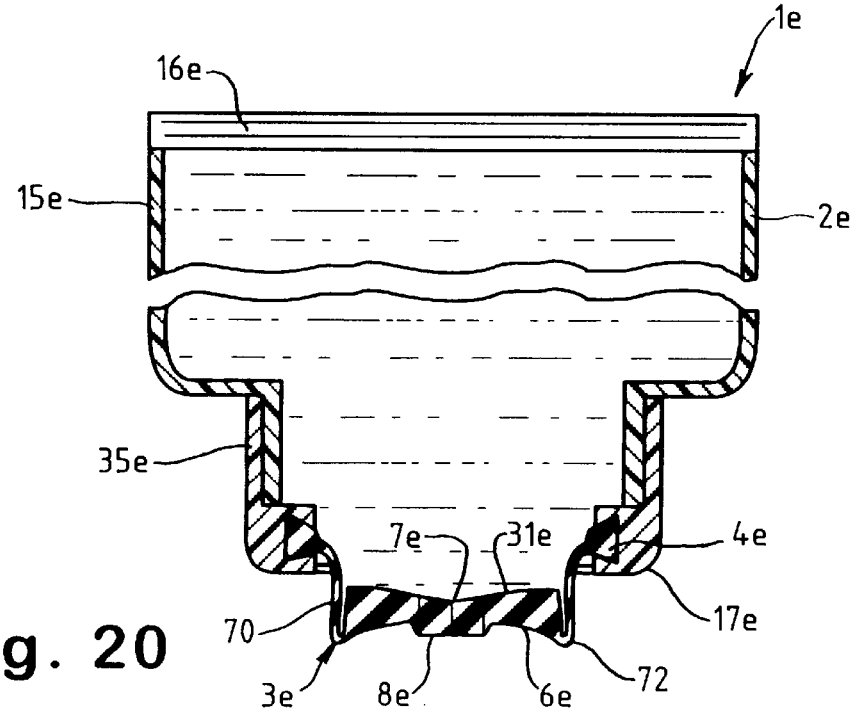
FIG. 20 is a fragmentary cross-sectional view of the dispensing package shown in FIGS. 18 and 19, wherein the valve is shown in a fully retracted and fully closed position immediately after dispensing.

In operation, dispensing package 1*e* functions in the following manner. To dispense fluid product from container 2*e*, pressure is applied to the sidewalls 15*e* of container 2*e*. The pressure generated within container 2*e* causes valve head 6*e* to shift from the fully retracted and fully closed position shown in FIG. 18 to the fully extended and fully open position shown in FIG. 19, thereby dispensing fluid product from container 2*e*. While valve head 6*e* shifts between extended and retracted positions, it does not double over like valve 6, which shifts a greater distance than valve 6*e*. When the pressure applied to container sidewalls 15*e* is released, valve head 6*e* shifts back to the fully retracted and fully closed position shown in FIG. 20. Should the sidewalls 15*e* of container 2*e* attempt to return to their original shape, thereby applying a vacuum to the interior of container 2*e*, as shown in FIG. 20, the vent resisting pad 8*e* on valve head 6*e* serves to prevent orifice 7*e* from opening, such that ambient air is not drawn back into the interior of container 2*e*.

The illustrated dispensing packages 1–1*e* are each configured to prevent air from being drawn back into the interior of the associated container after dispensing, such that the packages are particularly adapted for packaging air sensitive products. Each of the dispensing packages 1–1*e* has a self-sealing type of valve which opens and closes automatically for easy of use.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is as follows:

1. A non-venting dispensing package for fluid products, comprising:

a container shaped to retain a selected fluid product within a predetermined volume, and having an interior wall construction configured to reduce said predetermined volume as fluid product is dispensed from said package, and including a discharge opening therein;

a dispensing valve for controlling the flow of the fluid product from said container, having an interior surface interfacing with the fluid product in said container, and an oppositely oriented exterior surface interfacing with ambient environment; a marginal valve portion sealing about the discharge opening of said container, and retained in a generally fixed relationship therewith; a valve head portion having an orifice which shifts centrally with respect to said marginal valve portion between an extended open position to permit fluid flow therethrough in response to a predetermined discharge pressure within said container, and a retracted closed position to shut off fluid flow therethrough upon removal of the predetermined discharge pressure; and a connector sleeve portion having a resiliently flexible construction, with one marginal end area thereof connected with said marginal valve portion, and an opposite head end area thereof connected with said valve head portion; and a vent resisting pad disposed on said exterior surface of said valve head portion adjacent said orifice, and retaining said orifice in said closed position after each dispensing of fluid product from said container to prevent ambient air from being drawn through said orifice into said container.

2. A non-venting dispensing package as set forth in claim 1, wherein:

said vent resisting pad is disposed adjoining said orifice.

3. A non-venting dispensing package as set forth in claim 2, wherein:

said vent resisting pad is formed integrally with and projects outwardly of the exterior surface of said valve head portion, such that said orifice extends through said pad.

4. A non-venting dispensing package as set forth in claim 3, wherein:

said pad is disc-shaped.

5. A non-venting dispensing package as set forth in claim 4, wherein:

said valve head portion has a predetermined thickness at a thinnest point; and said pad has a thickness equal to at least 10 percent of said predetermined thickness of said valve head portion.

6. A non-venting dispensing package as set forth in claim 5, wherein:

said exterior surface of said valve head portion has a generally arcuate shape, and is oriented concave in said retracted closed position, as viewed from outside said container.

7. A non-venting dispensing package as set forth in claim 6, wherein:

said interior surface of said valve head portion has a generally arcuate shape, and is oriented convex in said retracted closed position, as viewed from inside said container.

8. A non-venting dispensing package as set forth in claim 1, wherein:

said vent resisting pad is formed integrally with and projects outwardly of the exterior surface of said valve head portion.

9. A non-venting dispensing package as set forth in claim 1, wherein:

said exterior surface of said valve head portion has a generally arcuate shape, and is oriented concave in said retracted closed position, as viewed from outside said container; and said interior surface of said valve head portion has a generally arcuate shape, and is oriented convex in said retracted closed position, as viewed from inside said container.

10. A non-venting dispensing package for fluid products, comprising:

a container shaped to retain a selected fluid product within a predetermined volume, and having an interior wall construction configured to reduce said predetermined volume as fluid product is dispensed from said package, and including a discharge opening therein;

a dispensing valve for controlling the flow of the fluid product from said container, having an interior surface interfacing with the fluid product in said container, and an oppositely oriented exterior surface interfacing with ambient environment; a marginal valve portion sealing about the discharge opening of said container, and retained in a generally fixed relationship therewith; a valve head portion having an orifice which shifts between an open position to permit fluid flow therethrough in response to a predetermined discharge pressure within said container, and a closed position to shut off fluid flow therethrough upon removal of the predetermined discharge pressure; and a connector sleeve portion having a resiliently flexible construction, with one marginal end area thereof connected with said marginal valve portion, and an opposite head end area thereof connected with said valve head portion; and a perforate retainer connected with said container, and including a vent resisting member abutting said interior surface of said valve head portion when said valve is in said closed position to retain said orifice in said closed position after each dispensing of fluid product from said container to prevent ambient air from being drawn through said orifice into said container.

11. A non-venting dispensing package as set forth in claim 10, wherein:

said vent resisting member abuts said valve head portion adjacent said orifice.

12. A non-venting dispensing package as set forth in claim 11, wherein:

said perforate retainer includes apertures through which the fluid product in said container flows.

13. A non-venting dispensing package as set forth in claim 12, wherein:

said vent resisting member retains at least a portion of said marginal valve portion to assist in retaining said valve on said container.

14. A non-venting dispensing package as set forth in claim 13, wherein:

said retainer includes an outer ring operably connected with said container, a center disc selectively abutting said valve head portion, and a plurality of radially extending spokes interconnecting said outer ring and said center disc.

15. A non-venting dispensing package for fluid products, comprising:

a container shaped to retain a selected fluid product within a predetermined volume, and having an interior configured to reduce said predetermined volume as fluid product is dispensed from said package, and including a discharge opening;

a dispensing valve for controlling the flow of the fluid product from said container, having an interior surface interfacing with the fluid product in said container, and an oppositely oriented exterior surface interfacing with ambient environment; a marginal valve portion sealing about the discharge opening of said container, and retained in a generally fixed relationship therewith; a valve head portion having an orifice which shifts between an open position to permit fluid flow therethrough in response to a predetermined discharge pressure within said container, and a closed position to shut off fluid flow therethrough upon removal of the predetermined discharge pressure; and a connector sleeve portion having a resiliently flexible construction, with one marginal end area thereof connected with said marginal valve portion, and an opposite head end area thereof connected with said valve head portion; and vent resisting means for retaining said orifice in said closed position after each dispensing of fluid product from said container to prevent ambient air from being drawn through said orifice into said container.

16. A non-venting dispensing package as set forth in claim 15, wherein:

said exterior surface of said valve head portion has a generally arcuate shape, and is oriented convex in said closed position, as viewed from outside said container.

17. A non-venting dispensing package as set forth in claim 16, wherein:

said interior surface of said valve head portion has a generally arcuate shape, and is oriented concave in said closed position, as viewed from inside said container.

18. A non-venting dispensing package as set forth in claim 17, wherein:

said vent resisting means comprises a pad disposed on said exterior surface of said valve head portion adjoining said orifice.

19. A non-venting dispensing package as set forth in claim 18, wherein:

said valve head portion is shaped to shift centrally with respect to said marginal valve portion between said closed position, wherein said valve head portion is retracted, and said open position, wherein said valve head portion is extended.

20. A non-venting dispensing package as set forth in claim 17, wherein:

said opposite head end area of said connector sleeve has an inverted J-shape which extends arcuately into said valve head portion to facilitate movement of said head portion when dispensing fluid product from said container.

21. A non-venting dispensing package as set forth in claim 15, wherein:

said vent resisting means comprises a perforate retainer connected with said container, and abutting said interior surface of said valve head portion when said valve is in said retracted closed position.

22. A valve for non-venting fluid dispensing packages of the type having a container shaped to retain a selected fluid product within a predetermined volume, with an interior wall construction configured to reduce the predetermined volume as fluid product is dispensed from the package, and a discharge opening therein; said valve comprising:

an interior surface interfacing with the fluid product in the container, and an oppositely oriented exterior surface interfacing with ambient environment; a marginal valve portion shaped for sealing about the discharge opening of the container, and retained in a generally fixed relationship therewith; a valve head portion having an orifice which shifts centrally with respect to said marginal valve portion between an extended open position to permit fluid flow therethrough in response to a predetermined discharge pressure within the container, and a retracted closed position to shut off fluid flow therethrough upon removal of the predetermined discharge pressure; and a connector sleeve portion having a resiliently flexible construction, with one marginal end area thereof connected with said marginal valve portion, and an opposite head end area thereof connected with said valve head portion;

a vent resisting pad disposed on said exterior surface of said valve head portion adjacent said orifice, and retaining said orifice in said closed position after each dispensing of fluid product from the container to prevent ambient air from being drawn through said orifice into the container.

23. A valve as set forth in claim 22, wherein:

said vent resisting pad is disposed adjoining said orifice.

24. A valve as set forth in claim 23, wherein:

said vent resisting pad is formed integrally with and projects outwardly of the exterior surface of said valve head portion, such that said orifice extends through said pad.

25. A valve as set forth in claim 24, wherein:

said pad is disc-shaped.

26. A valve as set forth in claim 25, wherein:

said valve head portion has a predetermined thickness at a thinnest point; and said pad has a thickness equal to at least 10 percent of said predetermined thickness of said valve head portion.

27. A valve as set forth in claim 26, wherein:

said exterior surface of said valve head portion has a generally arcuate shape, and is oriented concave in said retracted closed position, as viewed from outside the container.

28. A valve as set forth in claim 27, wherein:

said interior surface of said valve head portion has a generally arcuate shape, and is oriented convex in said retracted closed position, as viewed from inside the container.

29. A valve as set forth in claim 28, wherein:

said vent resisting pad is formed integrally with and projects outwardly of the exterior surface of said valve head portion.

* * * * *